US007155358B2

(12) United States Patent
Bamfield et al.

(10) Patent No.: US 7,155,358 B2
(45) Date of Patent: Dec. 26, 2006

(54) HIGHWAY-RAIL GRADE CROSSING REMOTE SETUP, CALIBRATION AND TROUBLESHOOTING

(75) Inventors: Richard Bamfield, Upland, CA (US); Brad Wilcox, San Bernardino, CA (US); Martin Paget, Anaheim Hills, CA (US)

(73) Assignee: Safetran Systems Corporation, Louisville, KY (US)

( * ) Notice: Subject to any disclaimer, the term of this patent is extended or adjusted under 35 U.S.C. 154(b) by 0 days.

(21) Appl. No.: 11/132,006

(22) Filed: May 18, 2005

(65) Prior Publication Data

US 2006/0265165 A1 Nov. 23, 2006

(51) Int. Cl.
*G01D 18/00* (2006.01)
*G06F 19/00* (2006.01)

(52) U.S. Cl. ..... 702/85; 702/122; 702/184

(58) Field of Classification Search ..... 702/85, 702/92, 93, 94, 116, 122, 184, 185, 95; 340/641, 340/657, 907; 701/301; 246/20, 115, 125
See application file for complete search history.

(56) References Cited

U.S. PATENT DOCUMENTS

2002/0185571 A1* 12/2002 Bryant et al. ..... 246/125
2004/0249571 A1* 12/2004 Blesener et al. ..... 701/301

OTHER PUBLICATIONS

INVENSYS—Application Guidelines, Microprocessor Based Grade Crossing Predictor Model 3000 Family.
Safetran System Corporation, Instruction & Installation, Solid-State Crossing Controller III Plus (SSCC 111 PLUS) 91190, 91195, Apr. 2004, Document No. SIG-00-02-03, Version D.
Safetran Systems Corporation, Instructions & Installation, Microprocessor Based Grade Crossing Predictor Mode; 3000 Family, Apr. 2002, Document No. SIG-00-00-02, Version B.

* cited by examiner

*Primary Examiner*—Bryan Bui
(74) *Attorney, Agent, or Firm*—Cook,Alex ,McFarron,Manzo,Cummings & Mehler, Ltd.

(57) ABSTRACT

A system for remotely calibrating or troubleshooting a highway-rail grade crossing using a communication device. A controller detects the approach and presence of a train on the rail, a communication link is coupled to the controller, a computer readable medium has a calibration or troubleshooting segment that is processed by the controller, the communication device communicates with the controller and the communication device sends signals to prompt the controller to selectively process the segment to enable the desired setup, calibration or troubleshooting functions. Related methods are also disclosed.

16 Claims, 13 Drawing Sheets

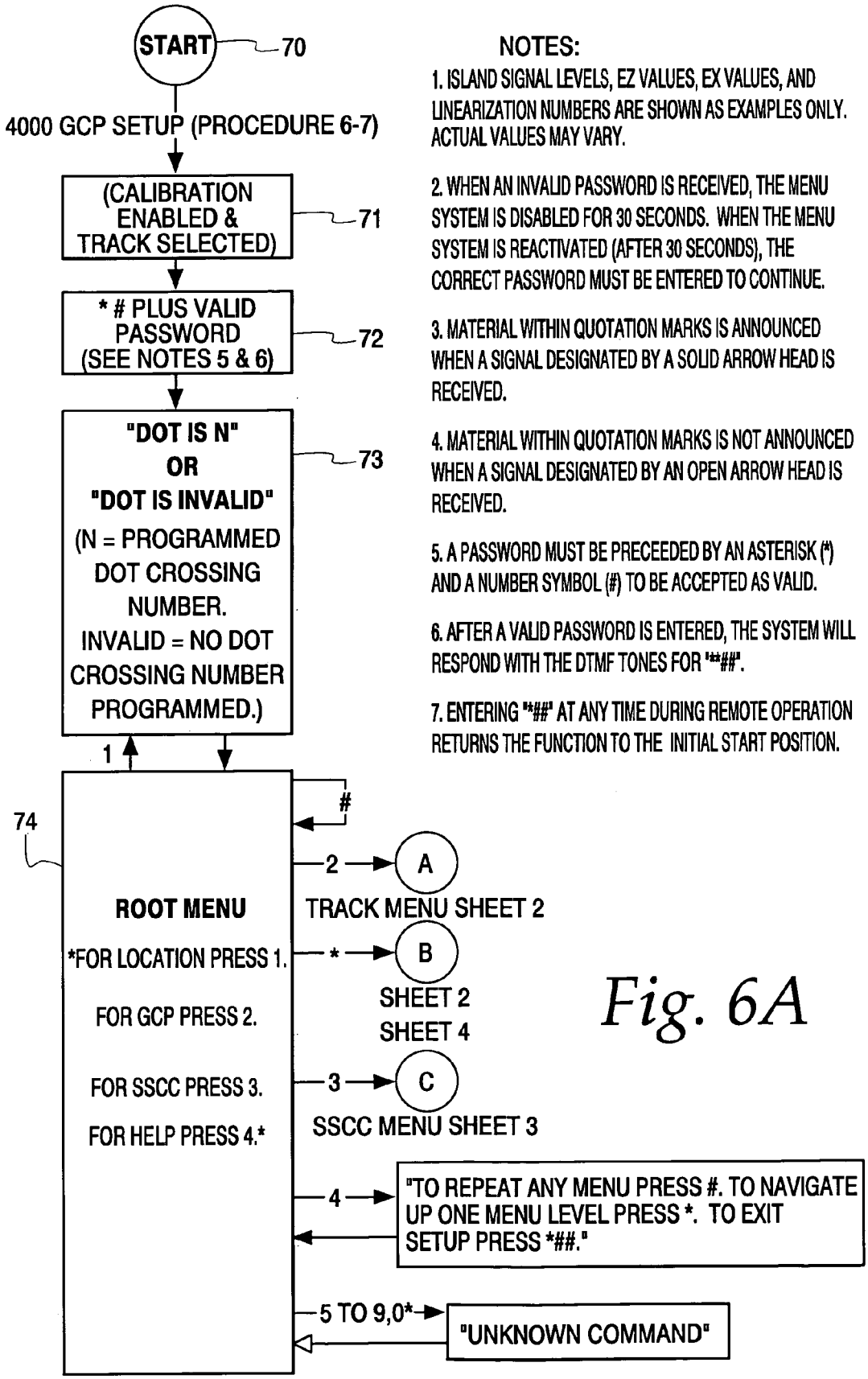

NOTES:

1. ISLAND SIGNAL LEVELS, EZ VALUES, EX VALUES, AND LINEARIZATION NUMBERS ARE SHOWN AS EXAMPLES ONLY. ACTUAL VALUES MAY VARY.

2. WHEN AN INVALID PASSWORD IS RECEIVED, THE MENU SYSTEM IS DISABLED FOR 30 SECONDS. WHEN THE MENU SYSTEM IS REACTIVATED (AFTER 30 SECONDS), THE CORRECT PASSWORD MUST BE ENTERED TO CONTINUE.

3. MATERIAL WITHIN QUOTATION MARKS IS ANNOUNCED WHEN A SIGNAL DESIGNATED BY A SOLID ARROW HEAD IS RECEIVED.

4. MATERIAL WITHIN QUOTATION MARKS IS NOT ANNOUNCED WHEN A SIGNAL DESIGNATED BY AN OPEN ARROW HEAD IS RECEIVED.

5. A PASSWORD MUST BE PRECEEDED BY AN ASTERISK (*) AND A NUMBER SYMBOL (#) TO BE ACCEPTED AS VALID.

6. AFTER A VALID PASSWORD IS ENTERED, THE SYSTEM WILL RESPOND WITH THE DTMF TONES FOR "*##".

7. ENTERING "*##" AT ANY TIME DURING REMOTE OPERATION RETURNS THE FUNCTION TO THE INITIAL START POSITION.

*Fig. 6A*

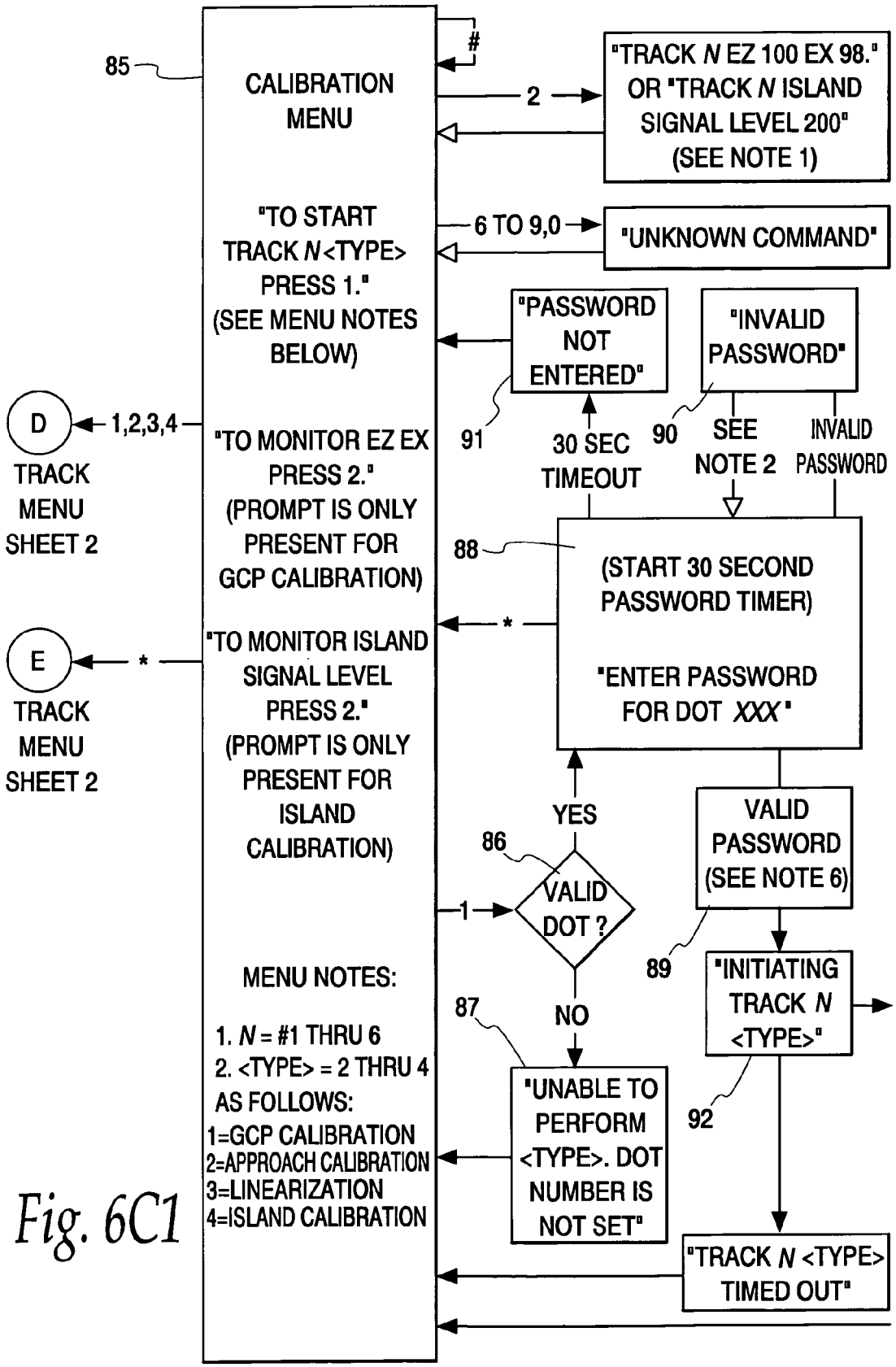
Fig. 6C1

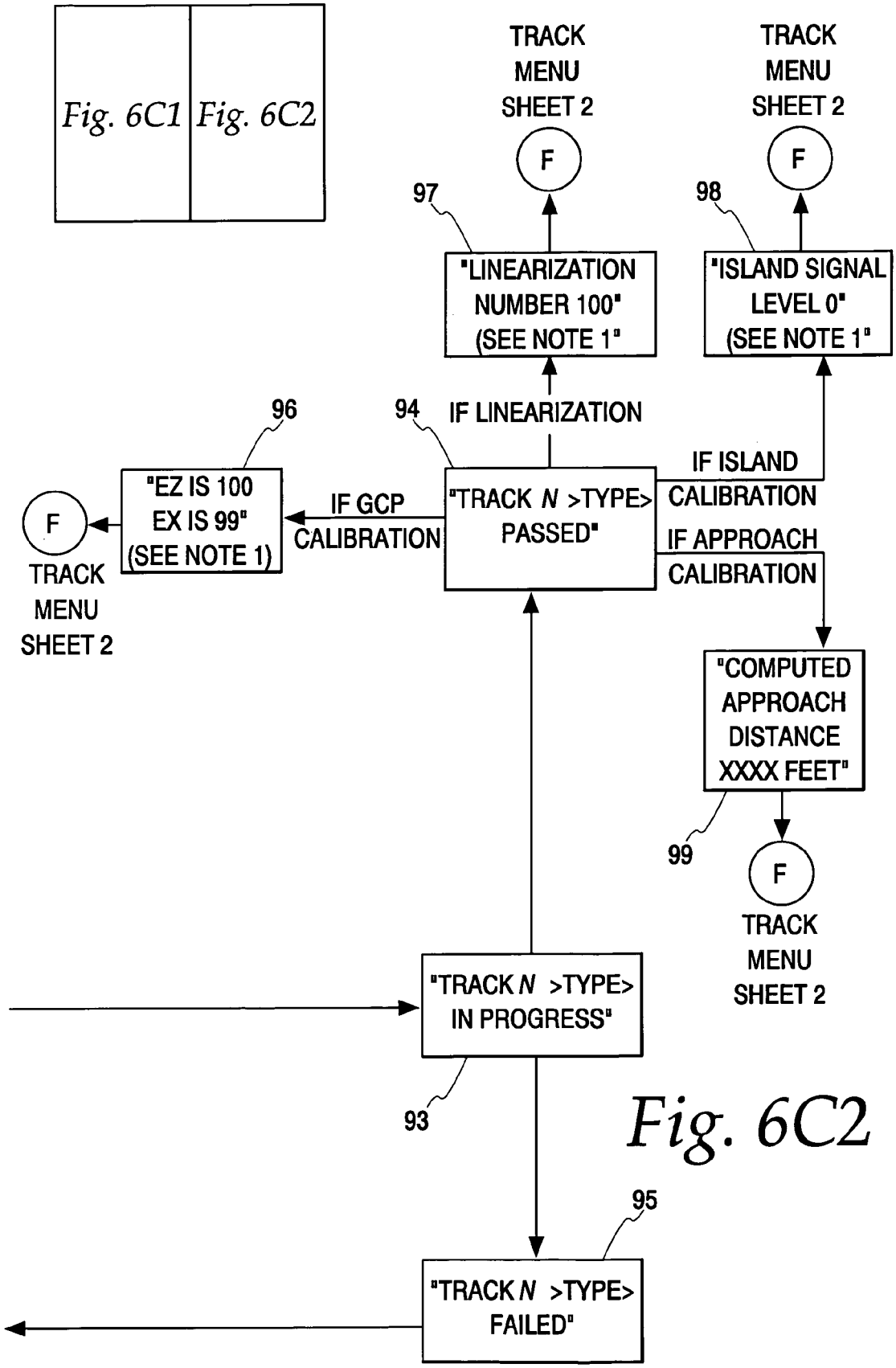
Fig. 6C2

*Fig. 6D1*
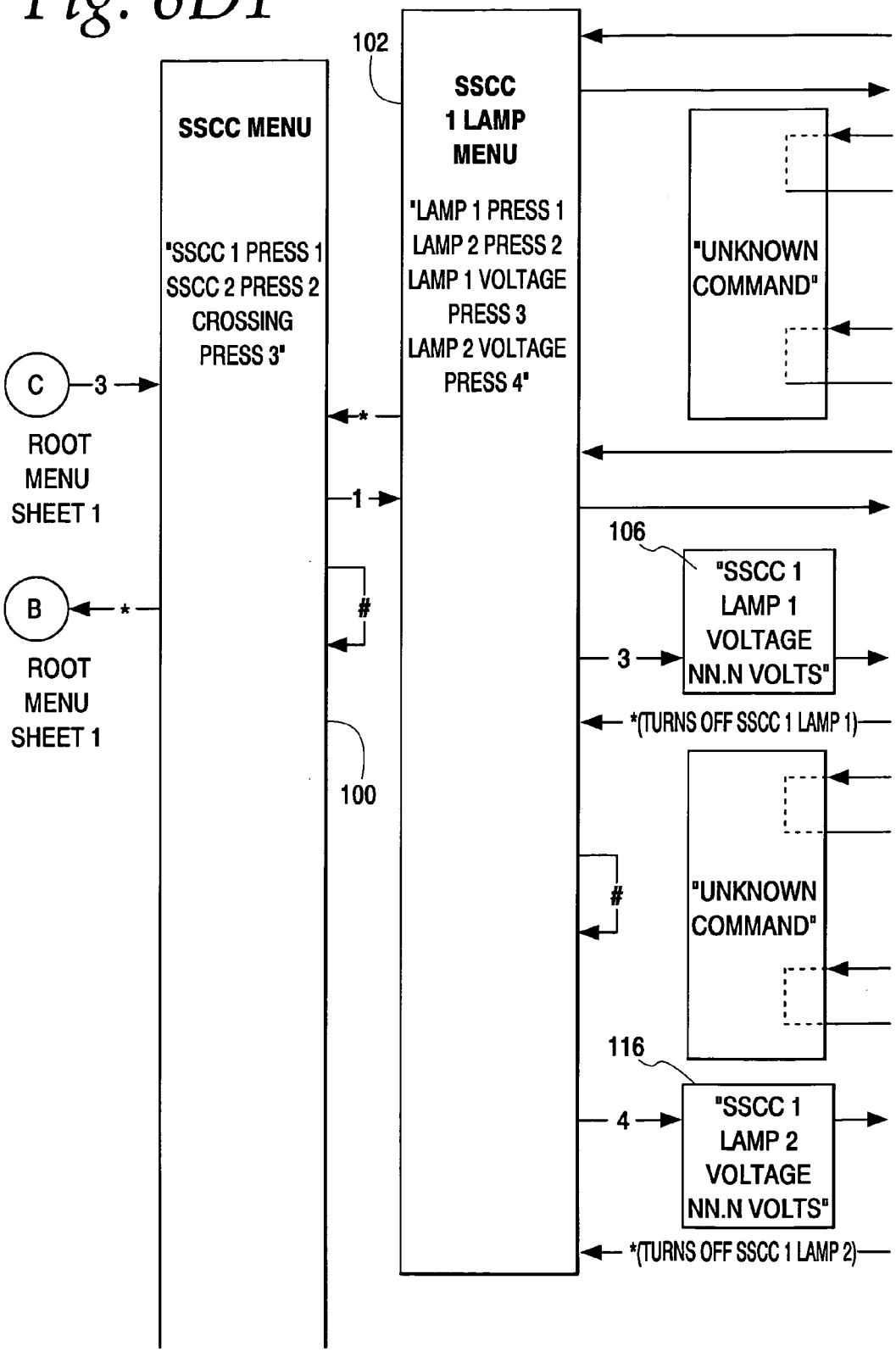

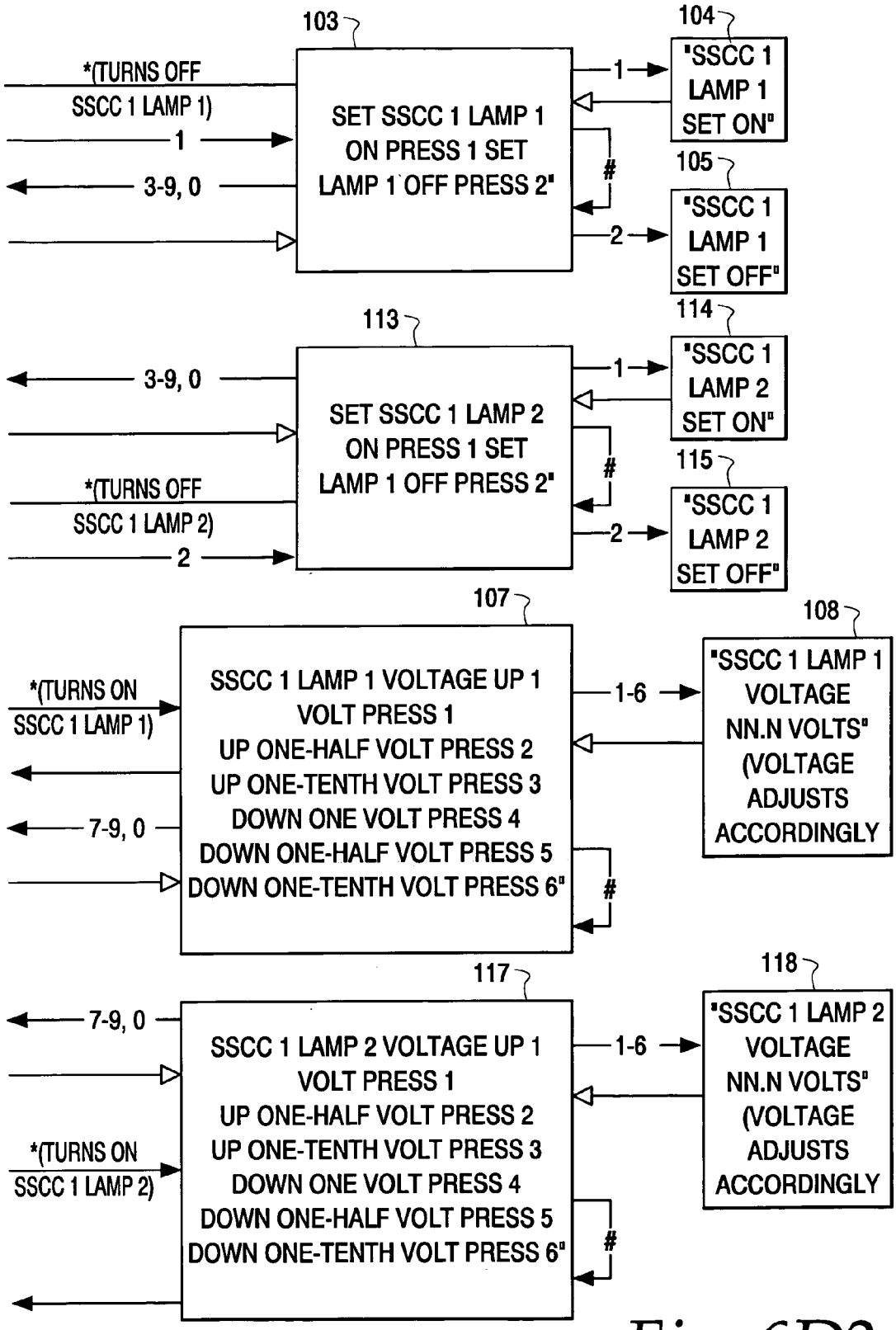
*Fig. 6D2*

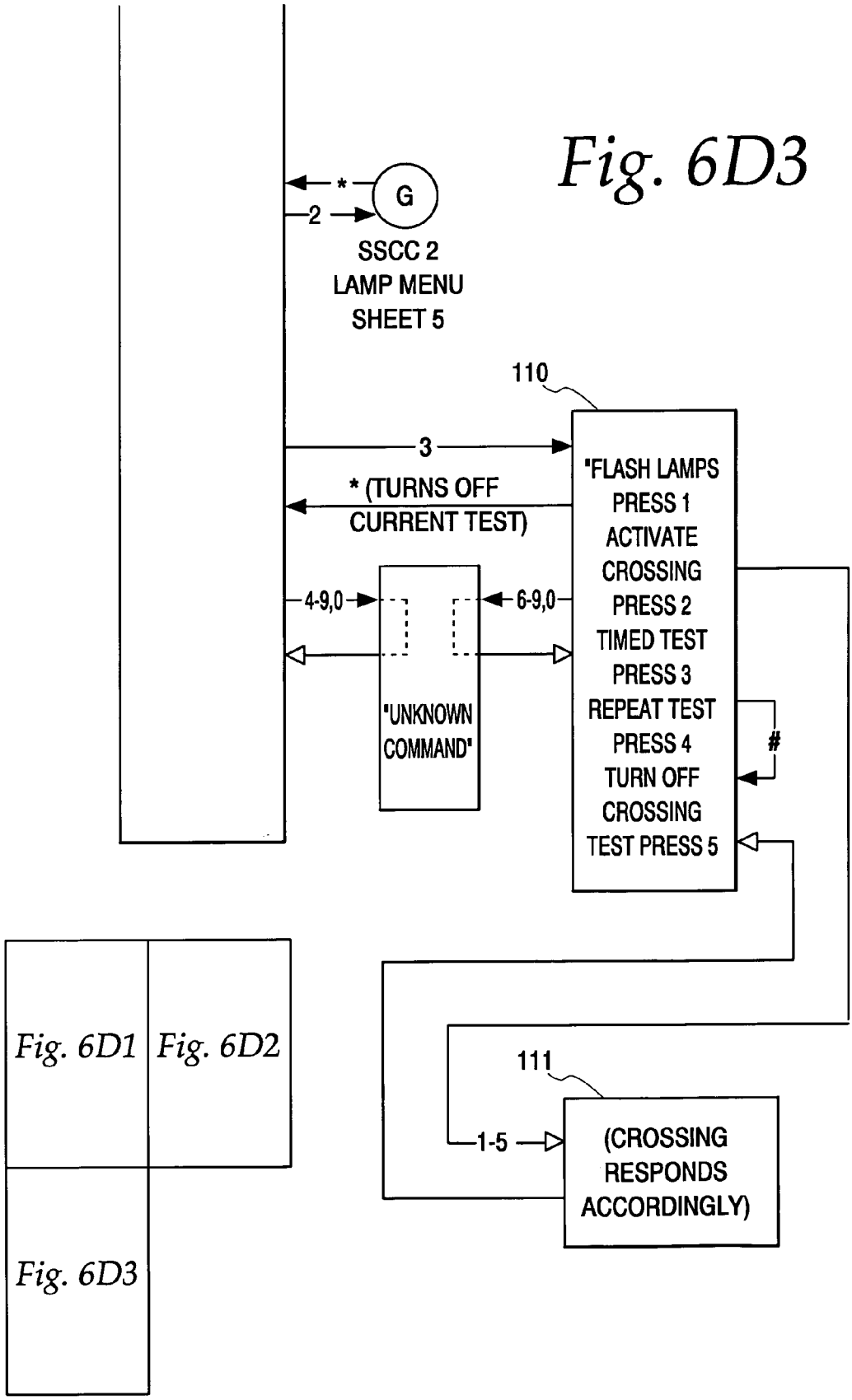
Fig. 6D3
*
G
2
SSCC 2
LAMP MENU
SHEET 5
110
3
"FLASH LAMPS
PRESS 1
ACTIVATE
CROSSING
PRESS 2
TIMED TEST
PRESS 3
REPEAT TEST
PRESS 4
TURN OFF
CROSSING
TEST PRESS 5
* (TURNS OFF
CURRENT TEST)
4-9,0
6-9,0
"UNKNOWN
COMMAND"

111
1-5
(CROSSING
RESPONDS
ACCORDINGLY)
Fig. 6D1
Fig. 6D2
Fig. 6D3

*Fig. 6E1*
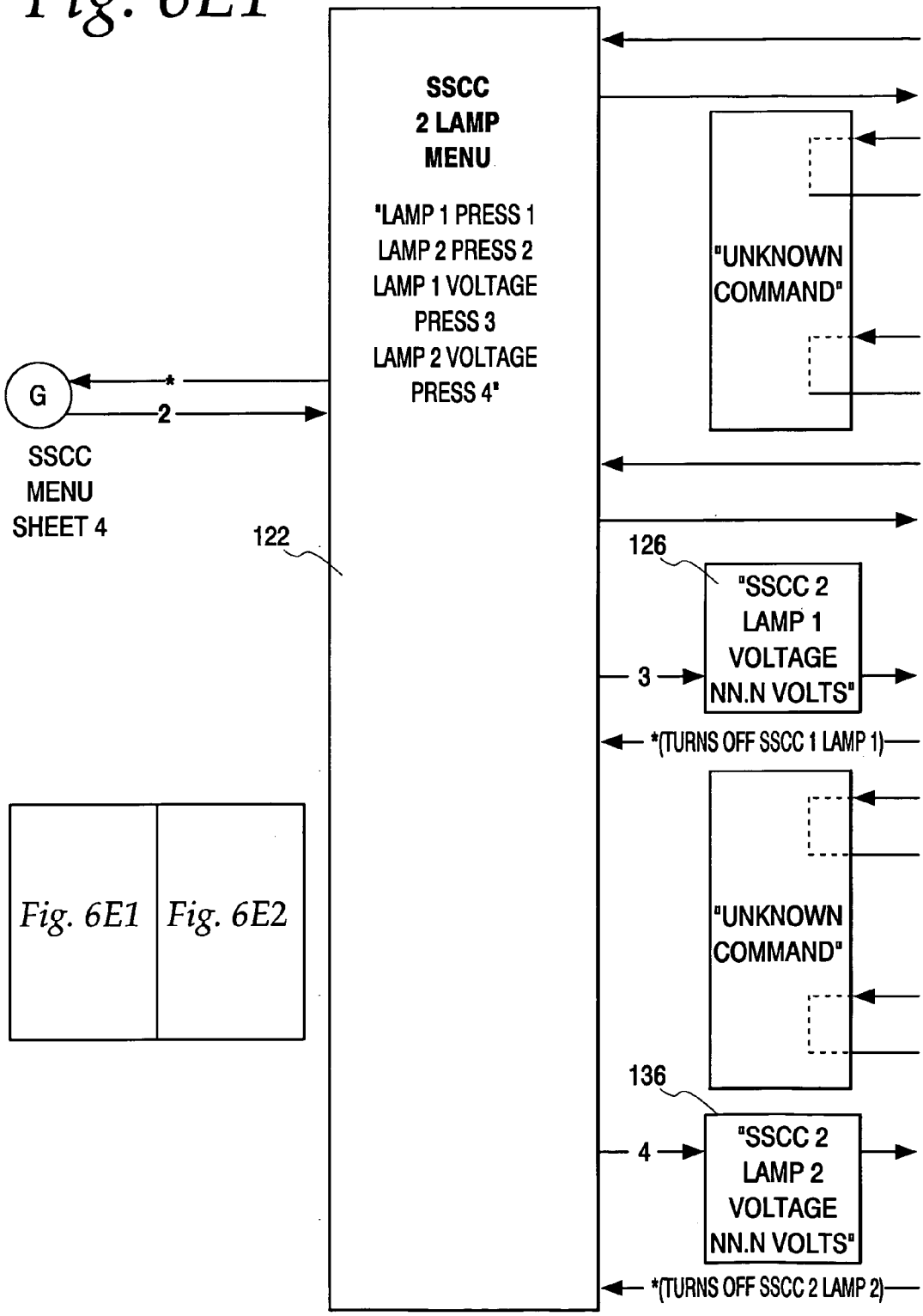
| | |
|---|---|
| *Fig. 6E1* | *Fig. 6E2* |

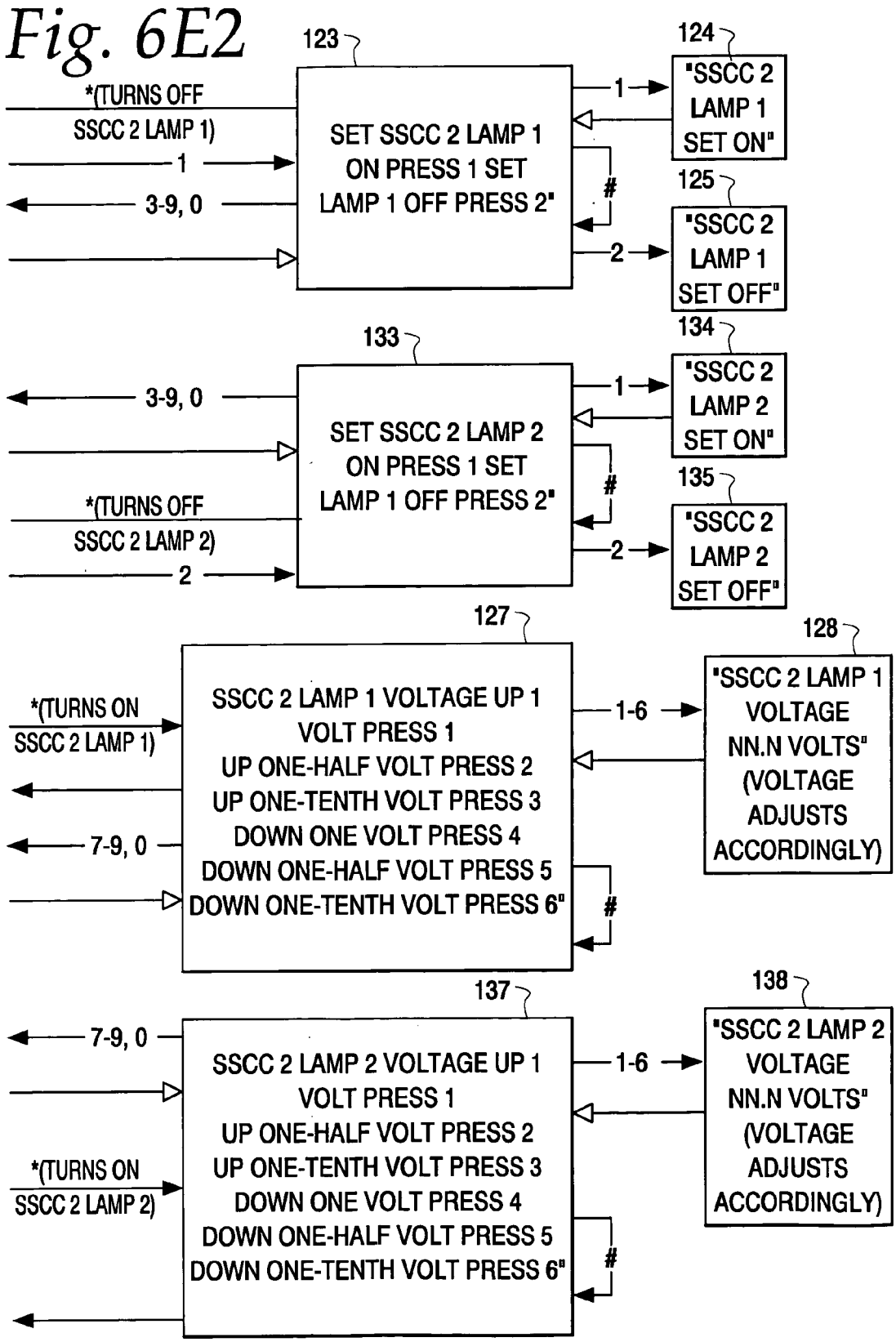
Fig. 6E2
123
*(TURNS OFF SSCC 2 LAMP 1)
1
3-9, 0
SET SSCC 2 LAMP 1 ON PRESS 1 SET LAMP 1 OFF PRESS 2"
1

2
124
"SSCC 2 LAMP 1 SET ON"
125
"SSCC 2 LAMP 1 SET OFF"
133
3-9, 0
*(TURNS OFF SSCC 2 LAMP 2)
2
SET SSCC 2 LAMP 2 ON PRESS 1 SET LAMP 1 OFF PRESS 2"
1

2
134
"SSCC 2 LAMP 2 SET ON"
135
"SSCC 2 LAMP 2 SET OFF"
127
*(TURNS ON SSCC 2 LAMP 1)
7-9, 0
SSCC 2 LAMP 1 VOLTAGE UP 1 VOLT PRESS 1
UP ONE-HALF VOLT PRESS 2
UP ONE-TENTH VOLT PRESS 3
DOWN ONE VOLT PRESS 4
DOWN ONE-HALF VOLT PRESS 5
DOWN ONE-TENTH VOLT PRESS 6"
1-6

128
"SSCC 2 LAMP 1 VOLTAGE NN.N VOLTS" (VOLTAGE ADJUSTS ACCORDINGLY)
137
7-9, 0
*(TURNS ON SSCC 2 LAMP 2)
SSCC 2 LAMP 2 VOLTAGE UP 1 VOLT PRESS 1
UP ONE-HALF VOLT PRESS 2
UP ONE-TENTH VOLT PRESS 3
DOWN ONE VOLT PRESS 4
DOWN ONE-HALF VOLT PRESS 5
DOWN ONE-TENTH VOLT PRESS 6"
1-6

138
"SSCC 2 LAMP 2 VOLTAGE NN.N VOLTS" (VOLTAGE ADJUSTS ACCORDINGLY)

HIGHWAY-RAIL GRADE CROSSING REMOTE SETUP, CALIBRATION AND TROUBLESHOOTING

FIELD OF THE INVENTION

The present invention relates generally to apparatus for highway-rail grade crossing warning systems. More particularly, the present invention relates to improved apparatus that provides for more efficient setup, calibration and troubleshooting of a warning system.

BACKGROUND OF THE INVENTION

A highway-rail grade crossing warning system is typically comprised of a train detection system, coupled with a crossing control system to provide appropriate warning to the road users, usually by means of flashing lights, barrier gates and bells. Recorders are also typically deployed to monitor the train detection and crossing control equipment. Such recorders are also of assistance in incident investigation and in equipment troubleshooting.

A track circuit based upon closed circuit fail-safe design principles is used to detect trains approaching a crossing. An interruption or disturbance in the circuitry or in the signals impressed on the rails to detect trains will activate the crossing warning devices. This track circuit is defined by the placement of special shunts at the end of the track circuit approach, and by the location of transmit and receive wires attached to the track, typically at the crossing. However, for certain remote applications there may not be a physical crossing.

Track circuits may be either unidirectional or bi-directional. A special section of the track circuit that typically encompasses the highway-rail intersection is called the island circuit. This is usually defined by the area between transmit and receive leads for the track circuit for the entire approach. The same track leads are used for the island and the approach, although different signals are used.

Current industry practice for troubleshooting and calibrating electronic highway grade crossing equipment track circuits and flashing warning light voltages is to employ two people. One person is typically located on the track circuit or near the light circuits, and the second person is typically located near the equipment to control and monitor the track circuit and to adjust the output to the warning lights. The first person will typically be placing shunting wires on the track circuit or measuring light voltages. The second person will typically interact with the equipment to initiate calibration or setup procedures, as well as to record certain system parameters. These two people typically interact by means of standard VHF two-way radio handsets, by cell phones or by other two-way communication devices since approaches can be on the order of 4500 feet or more.

Many of the calibration and troubleshooting track circuit functions require shunts to be placed on the track prior to starting the calibration or troubleshooting procedures. Thus, coordination between the two persons is of key importance. VHF handsets are typically standard issue for railroad maintenance staff. In certain cases only one person may be available. If so, this means that the single person has to make multiple trips out to place shunts on the track and then return to the equipment to perform the calibration or troubleshooting procedures. This also means that the maintenance procedures can take a significantly longer time as compared to the use of two persons. Most track calibration or other maintenance procedures also require that protected track time be obtained from dispatchers. That is, no trains are allowed on the track during such maintenance procedures. Thus, minimizing the time to perform these maintenance procedures is of great benefit to the railroad. It is also of benefit to the road user, and helps the credibility of the crossing.

A general object of the present invention is to emulate the role of a second person while performing maintenance or troubleshooting procedures so that these procedures can be effectively performed by a single person.

Another object of the present invention is to provide for significant time savings as compared to a single person attempting to perform maintenance or trouble shooting procedures without use of the present invention.

A further object of the present invention is to provide closed-loop, fail-safe controls to insure that only the intended crossing is affected by the intended procedures.

Yet another object of the present invention is to provide for more efficient maintenance and troubleshooting procedures that are compatible with existing equipment, such as VHF communication device handsets.

SUMMARY OF THE INVENTION

This invention is directed to a system for remotely calibrating or troubleshooting a highway-rail grade crossing from a communications device, such as a two-way radio. The grade crossing includes at least one warning device. The system includes a controller for detecting the approach and presence of a train on the rail, a communication link coupled to the controller, a computer readable medium having a setup, calibration or troubleshooting segment that is processed by the controller, a communications device for communicating with the controller through the communication link and means on the communications device for prompting the controller to selectively process the setup, calibration or troubleshooting segment of the computer readable medium.

The computer readable medium may have a plurality of segments, including a priming segment for priming the controller for remote operation from the communications device, an identifying number segment for requesting entry of an identifying number for the highway-rail grade crossing at the communications device, a segment for enabling calibration or monitoring options from the communications device, a segment for enabling track calibration or track monitoring options from the communications device, a segment for enabling calibration of an approach circuit of the rail from the communications device, a segment for enabling calibration of an island circuit of the rail from the communications device, a segment for enabling calibration or monitoring of the warning device from the communications device, and a segment further enabling calibration of at least one lamp in the warning device from the communications device.

The present invention is further directed to methods of remotely calibrating or troubleshooting a highway-rail grade crossing including at least one warning device. The methods may include the steps of providing a controller for detecting the approach and presence of a train on the rail, coupling a communication link to said controller, processing a computer readable medium with the controller, the computer readable medium having a setup, calibration or troubleshooting segment, communicating between a communications device and the controller through the communication link, and prompting the controller from said communications device to selectively process the setup, calibration or troubleshooting segment of the computer readable medium.

Further steps of the methods may include priming the controller for remote operation from the communications device by processing a priming segment, requesting entry of an identifying number for the highway-rail grade crossing at the communications device by processing an identifying number segment, enabling calibration or monitoring options from the communications device, enabling track calibration or track monitoring options from the communications device, enabling calibration of an approach circuit of the rail from the communications device, enabling calibration of an island circuit of the rail from the communications device, enabling calibration or monitoring of the warning device from the communications device, and enabling calibration of at least one lamp in the warning device from the communications device.

BRIEF DESCRIPTION OF THE DRAWINGS

The invention, together with its objects and the advantages thereof, may best be understood by reference to the following description taken in conjunction with the accompanying drawings, in which like reference numerals identify like elements in the figures, and in which:

FIGS. 6A, 6B, 6C1, 6C2, 6D1, 6D2, 6D3, 6E1 and 6E2 are flow charts illustrating the methods of remotely performing setup, calibration and troubleshooting procedures for the grade crossing controller from a remotely located radio shown in FIG. 4 in communication with the controller shown in FIG. 3, in accordance with the present invention.

DESCRIPTION OF THE PREFERRED EMBODIMENTS

It will be understood that the invention may be embodied in other specific forms without departing from the spirit thereof. The present examples and embodiments, therefore, are to be considered in all respects as illustrative and not restrictive, and the invention is not to be limited to the details given herein.

Figure 1:
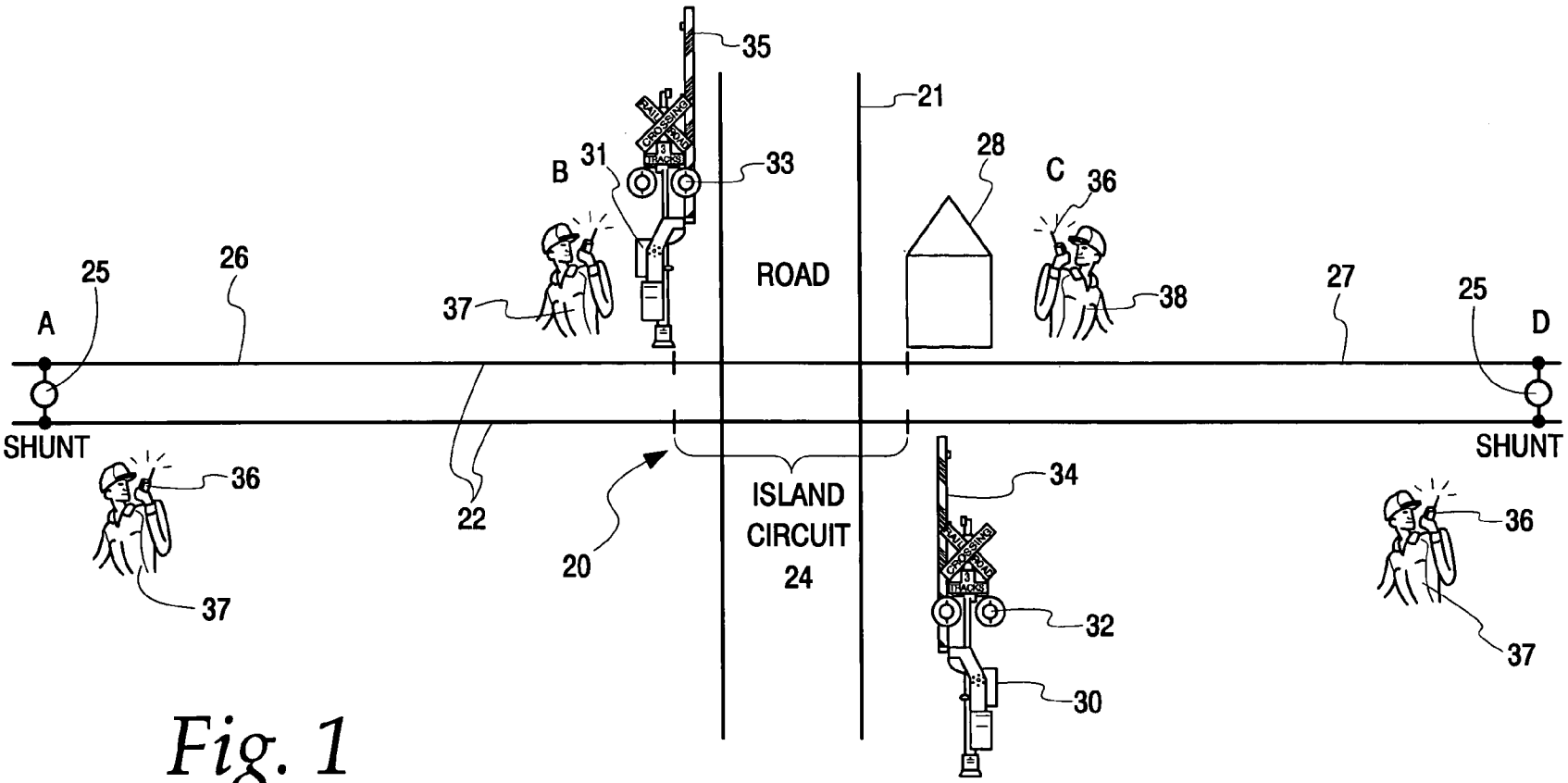
Fig. 1 (PRIOR ART)
FIG. 1 is a diagrammatic illustration of a prior art method of one maintainer at locations along a railroad track communicating with a second maintainer located at the controller for the highway-rail warning system.
Figure 3:
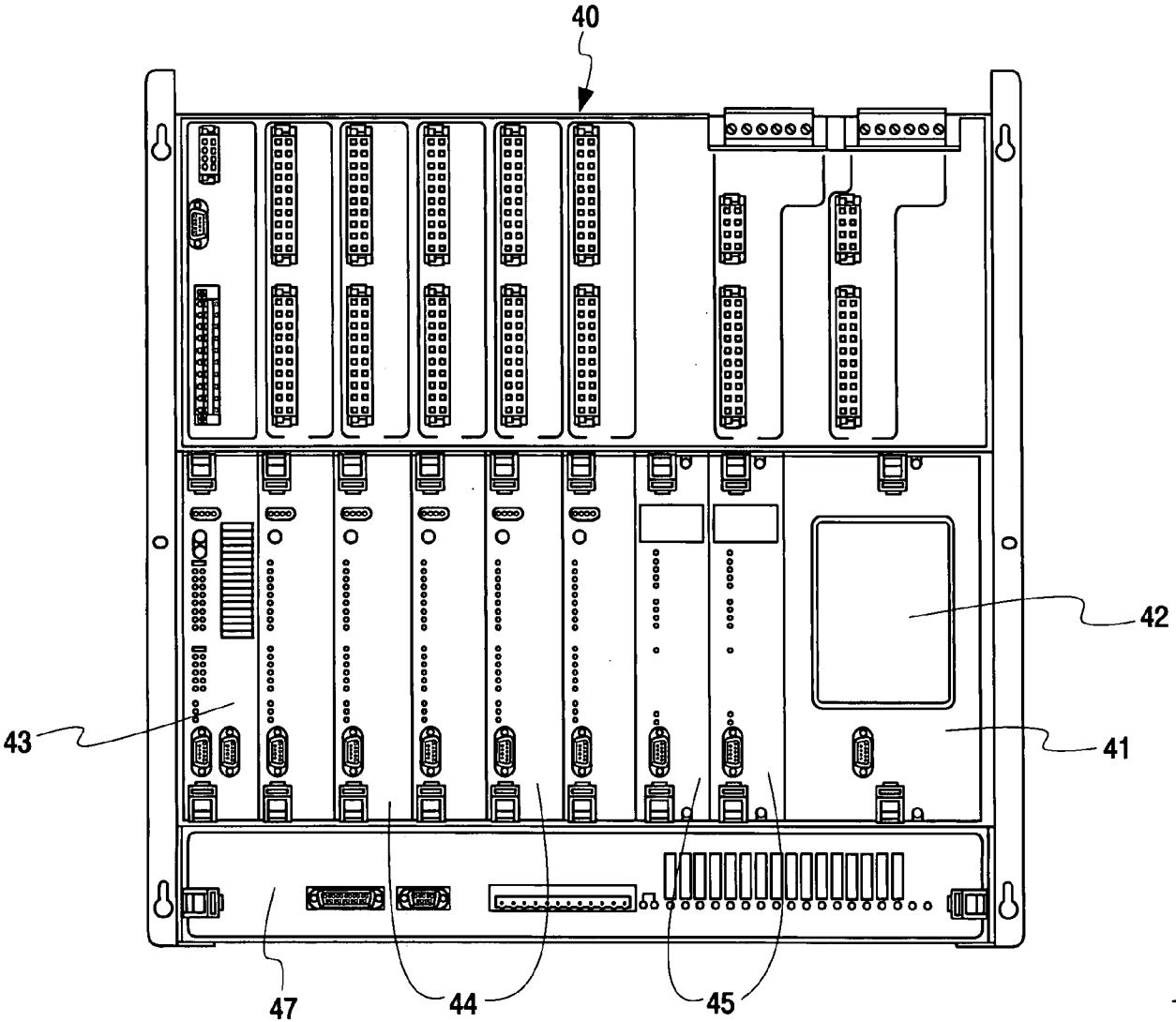
FIG. 3 is an elevational view of a controller in accordance with the present invention for the highway-rail grade warning system of FIG. 2.

With reference to the drawing Figures, FIG. 1 illustrates a highway-rail crossing, generally indicated by reference numeral 20, at a road 21 and at one or more railroad tracks 22, each railroad track consisting of two rails. A Grade Crossing Predictor (GCP) system or controller 40 in FIG. 3 is enclosed within a generally weatherproof bungalow or housing 28 and usually in general proximity to at least one of the railroad tracks 22.

In a conventional manner, at least that portion of railroad track 22 that intersects with the road 21 is included in an island circuit 24 that is monitored by the warning system controller 40 in housing 28. Similarly, those portions of track 22 that lie to the right and to the left of the island circuit 24 are included in an approach circuit and are identified by reference numerals 27 and 26, respectively. Approach circuits 26 and 27 are also monitored by the controller. Traffic warning devices 30 and 31 are typically placed on both sides of track 22 and adjacent to road 21. These traffic warning devices are provided with flashing lamps 32 and 33, may be provided with gates 34 and 35 that may be lowered and audible devices, such as a bell (not shown) or the like, in a known manner. When a train is detected in the approach circuits 26 and 27 or in the island circuit 24, controller 40 activates the flashing lights 32 and 33 and the audible devices and causes the gates 34 and 35 of traffic warning devices 30 and 31 to be lowered.

In the prior art example of FIG. 1, any setup, calibration or testing of the warning system typically requires at least two maintainers, such as maintainers 37 and 38 each equipped with a communication device 36, such as a two-way radio. For example, to complete some of the tests or calibration, the first maintainer 37 may be required to place a temporary hard wire shunt across the track 22 at the far end of the approach circuit 26 at location A near a permanent shunt 25 in FIG. 1. Location A may be up to 4500 feet from the controller in the housing 28. A second maintainer 38 may be located at location C by the housing 28 to monitor the controller 40, to monitor the results of the tests or calibration, and to enter various parameters into the controller 40, as needed. The first maintainer 37 may relocate to other locations along track 22, such as at location B near the island circuit 24 as shown in FIG. 1, or at the far end of the other approach circuit 27 at location D, as needed, to complete the test or calibration procedures. Of course, a third maintainer could also be used, if desired, to reduce the distances along track 22 covered by the first maintainer 37.

Figure 2:
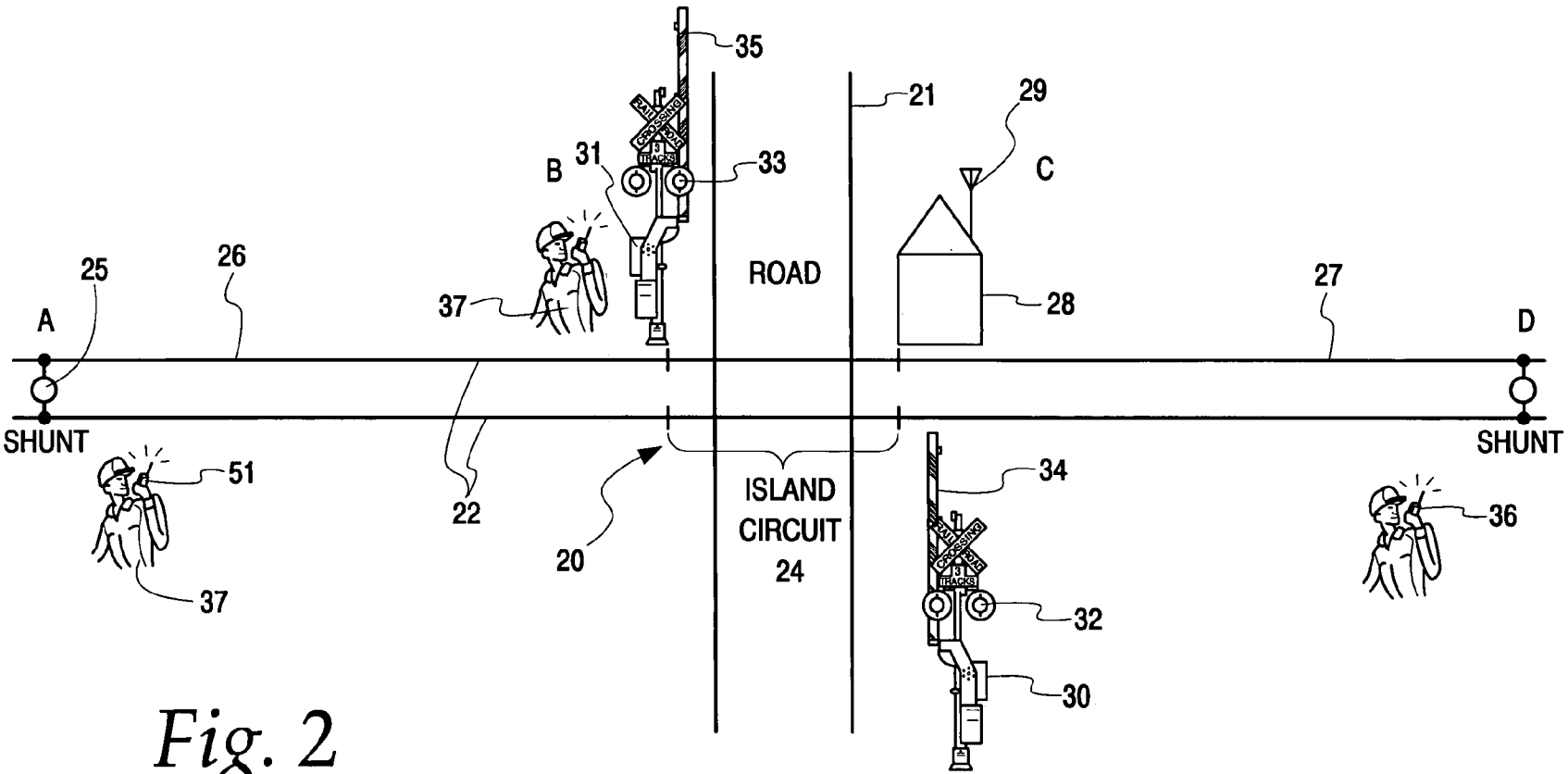
FIG. 2 is a diagrammatic illustration of a method in accordance with the present invention in which a single maintainer may be located at different locations along a railroad track and communicate directly with the controller for the highway-rail grade warning system to perform maintenance and troubleshooting procedures.

The present invention uses a combination of hardware and software to effectively emulate the role of the second person or maintainer 38 in FIG. 1 that formerly stayed with the equipment at housing 28 during calibration and troubleshooting of the highway-rail grade crossing warning system. In accordance with the present invention, a single person or maintainer 37 can calibrate or troubleshoot the warning system 20 through the operation of a two-way radio 51 that is in communication with the controller 40, irrespective of whether the maintainer 37 is located at locations A, B or D in FIG. 2. Instead of communicating with other communication devices 36 held by other maintainers, as in FIG. 1, the communication device 51 of the present invention communicates directly with the controller 40 in FIG. 3. To this end, housing 28 in FIG. 2 is equipped with an antenna 29 to receive communication device signals from communication device 51 and to transmit communication device signals from the controller 40 to communication device 51. For example, communication device 51 may be capable of sending voice over prescribed VHF frequencies, as well as receiving and sending dual-tone multi-frequency (DTMF) tones in the process of calibrating or troubleshooting of the warning system 20. Communication device 51 is also preferably equipped with a DTMF keypad similar to those found on many telephone handsets. These signaling operations are presented in greater detail below.

Antenna 29 may also be utilized to receive communication device signals from a railroad operations center and to transmit communication device signals to the operations center. For example, controller 40 may receive inquiries from the operations center and it may transmit information to the operations center including status information, operational information, information relating to errors or malfunctions, and the like.

With reference to FIG. 3, the GCP system or controller 40 is an integrated system that includes all of the control, train detection, recording and monitoring functions for the highway-railroad grade crossing warning system 20, such as for the highway-rail crossing shown in FIG. 2. The railroad grade crossing shown in FIG. 2 may include a plurality of tracks 22, instead of the single track shown. Likewise, controller 40 may monitor and control a plurality of tracks 22; for example, typically up to six tracks. Controller 40 is usually located along the railroad right of way, such as in housing 28 in FIG. 2 near or adjacent to one of the tracks 22.

As shown in FIG. 3, controller 40 includes a plurality of modules. One of these modules is a display module 41 with a display 42. Preferably, display 42 is a touch screen display that provides a user interface. For example, the Windows CE® operating system, commercially available from the MicroSoft Corporation of Redmond, Wash., may be employed in controller 40 to provide touch screen display capabilities for display 42 that allow the signal maintainer to more easily program and configure the various parameters, such as during initial setup of the system. Other modules may include a central processing unit (CPU) 43, track modules 44 for monitoring each track, crossing control modules 45 for controlling the traffic warning gates 30 and 31, and a recorder module 47 for recording events and conditions at the highway-rail grade crossing 20. As shown in FIG. 3, each of modules 41 and 43–47 may have external connectors, test points and lighted indicators.

Figure 4:
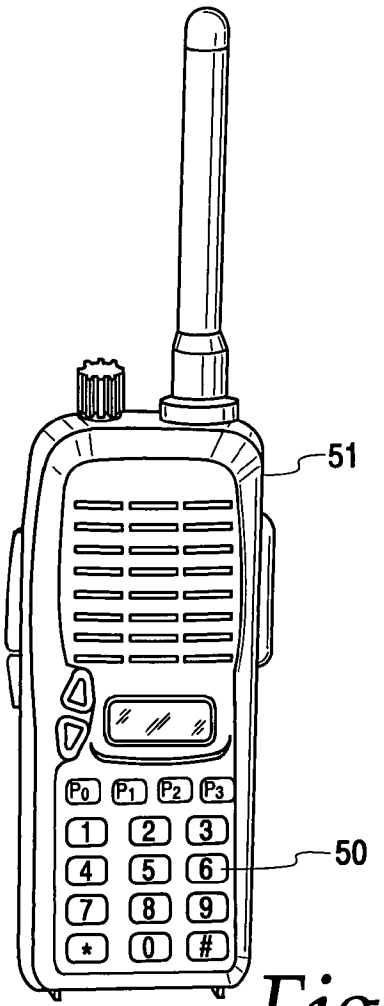
FIG. 4 is an elevational view of a two-way radio for communicating with the controller shown in FIG. 3 to setup, calibrate or troubleshoot the highway-rail grade warning system of FIG. 2.

Shown in FIG. 4 is typical communication device 51 for communicating with controller 40 to setup, calibrate or troubleshoot the highway-rail grade warning system shown in FIG. 2. For example, communication device 51 may be a portable VHF two-way radio. Preferably, this communication device is equipped with a means for responding to options or commands issued by controller 40, as is presented in greater detail below, such as a numeric keypad 50. Pressing one of the keys on keypad 50 may send a dual-tone, multi-frequency (DTMF) signal to controller 40.

Figure 5:
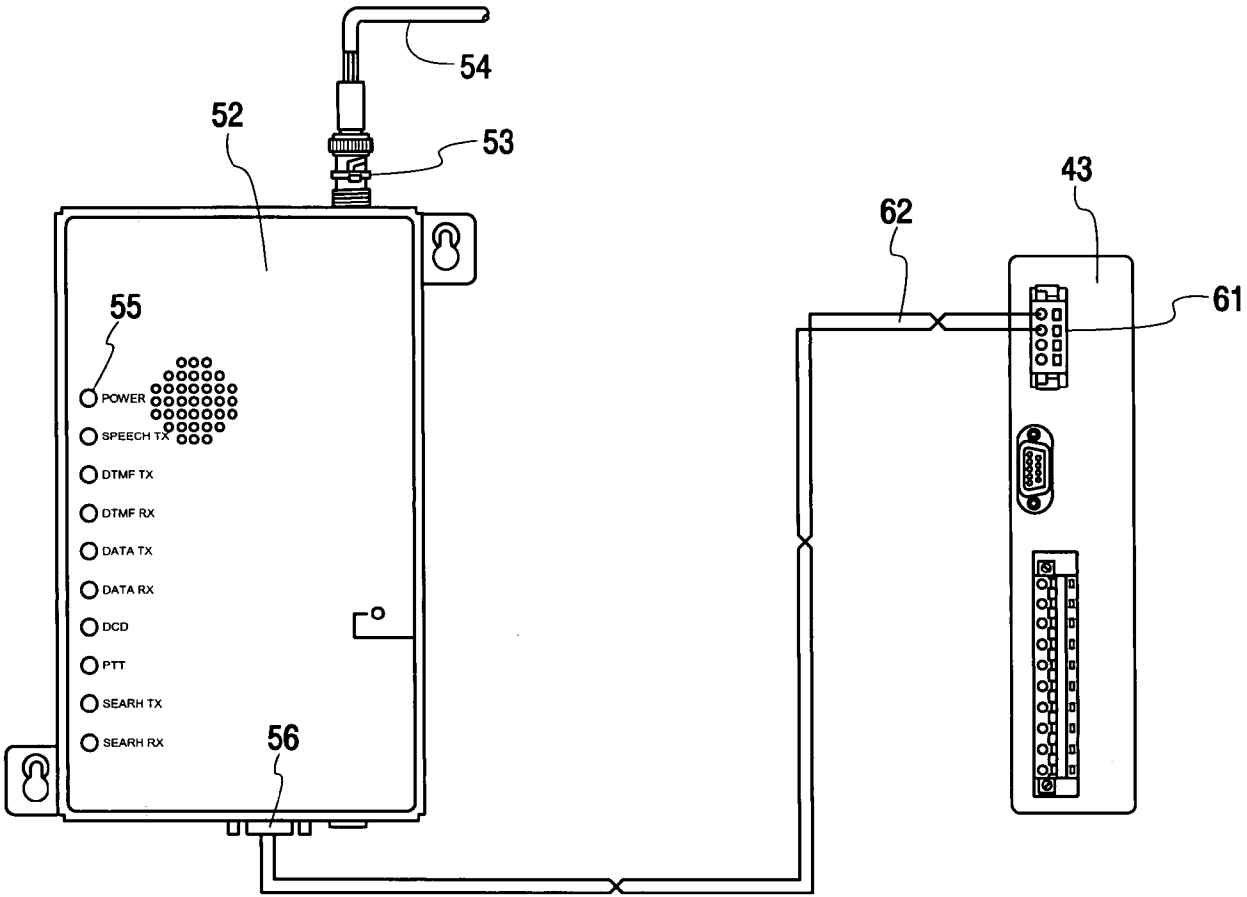
FIG. 5 is a diagrammatic illustration of a communications link with a local area network, which, in turn, is connected to a central processing unit of the controller of FIG. 3 to interface communications between the radio shown in FIG. 4 and the controller shown in FIG. 3.

Also in accordance with the present invention, controller 40 also includes a VHF communication module 52 (FIG. 5) to provide a communications link from antenna 29 to the CPU module 43 of controller 40, thus facilitating communication between communication device 51 and controller 40. For example, communication module 52 translates a radio frequency signal received from radio and may also provide a local area network function in interfacing with CPU 43. Module 52 has an antenna connector 53 to connect a cable 54 from the communication module 52 to the antenna 29. Communication module 52 may also be provided with a plurality of lighted indicators, such as Power indicator 55. Additional indicators may include Speech TX (speech transmit), DTMF TX, DTMF RX (DTMF receive), DATA TX, DATA RX, DCD, PTT (push-to-talk), SEARii TX (recorder transmit) and SEARii RX to indicate various modes of operation that are occurring.

Communication module 52 is electrically coupled to CPU 43, such as by a twisted pair of conductors 62 between respective connectors 56 and 61. Communication module 52 thus translates the information received from communication device 51 to CPU 43. Likewise, communication module 52 translates information from CPU 43 to be sent to communication device 51. Of course, other means of providing a communication link between communication device 51 and controller 40 will be apparent to those skilled in the art. For example, alternate forms of communications links may include a satellite link, cellular telephone link, or the like.

The controller 40 and the communication device 51 typically interact to provide voice messages that the maintainers receive on the communication device 51, as well as transmit input DTMF commands from the communication device to controller 40. The system uses a voice-based menu structure, with voice prompts asking the maintainer to select appropriate options from a menu. As some of the operations can affect the safety-critical operation of the crossing warning system 20, protection mechanisms are implemented to ensure that inadvertent operations are not performed. With such a communication format, the following remote operations can be performed:

1. Location announcement (Department of Transportation (DOT) number, which is a unique number assigned to each highway-rail crossing or other configured or identifying number), 2. Calibration of the track circuit into the shunt at the end of the track circuit approach ("GCP calibration"), 3. Calibration of the approach track circuit into a hard-wired shunt placed at the end of the approach ("approach calibration"), 4. Calibration of the track circuit linearization into a hard-wired shunt placed at 50% of the approach distance ("linearization calibration"), 5. Calibration of the island track circuit into a hard-wired shunt placed at a prescribed distance outside of the island circuit, 6. Monitoring of relative train position ("EZ") and track condition status ("EX"), 7. Monitoring of island signal level ("Z"), 8. Calibration of lamp voltage for flashing warning lights, and 9. Activation of test modes (lamp flash, crossing activation, timed tests, repeat test).

Figure 6B:
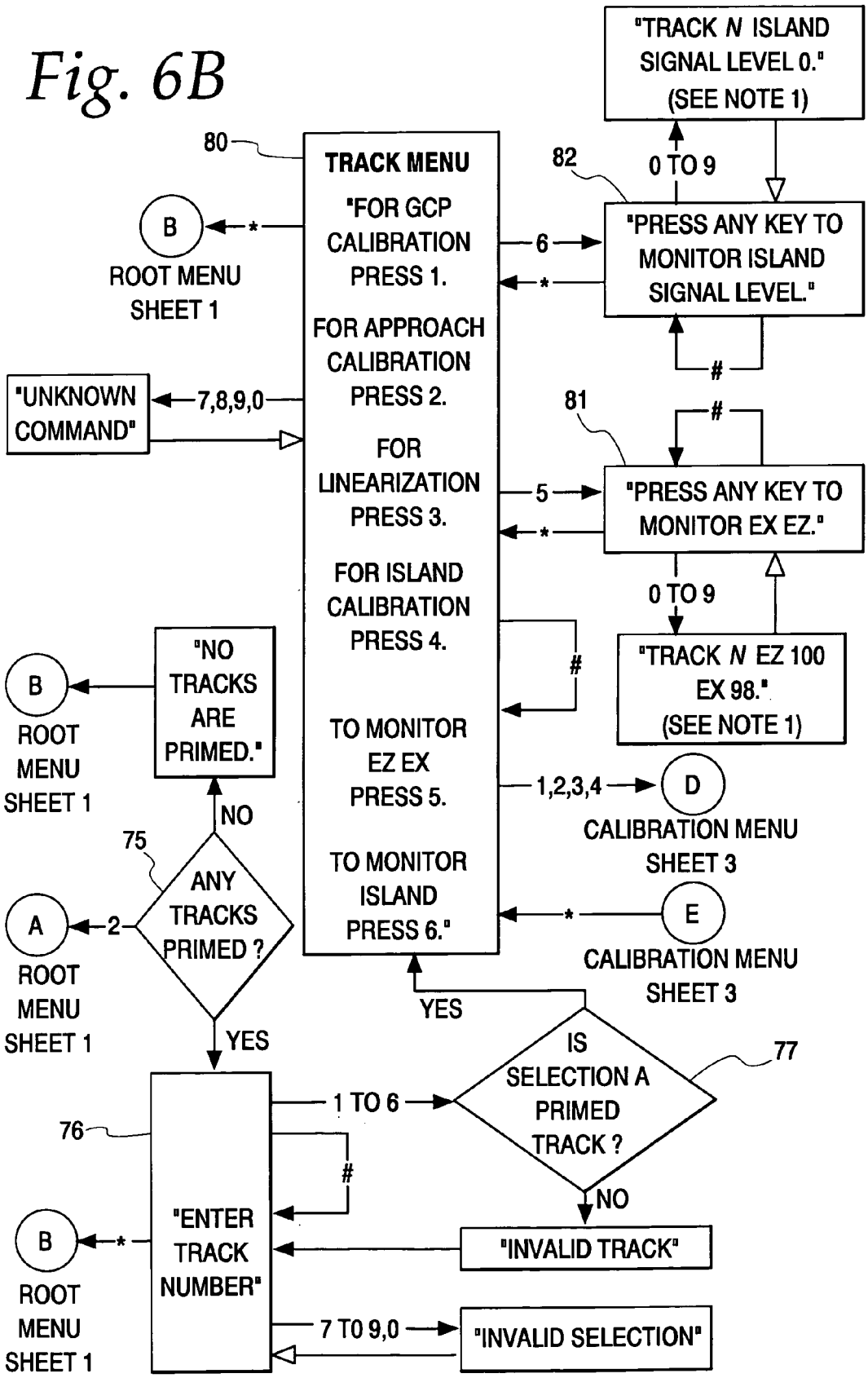

With reference to FIGS. 6A through 6E2, performance of the above remotely controlled operations will be presented in greater detail. The various blocks or steps shown in FIGS. 6A–6E2 may be a computer program or computer readable medium that has a plurality of segments. This plurality of segments may be, for example, various menus that are described in further detail below. Various setup, calibration or troubleshooting options within these menus may be presented at the communication device 51 and the maintainer may typically activate the desired option by pressing the related numeric key on communication device 51. Selection of the desired option on communication device 51 will be transmitted to the communication link shown in FIG. 5 and then presented to CPU 43 of controller 40. CPU 43 will typically act upon the selection of the desired option from communication device 51 and process the appropriate segment of the computer program. Further options associated with the particular selected segment may then be transmitted from CPU 43 to communication device 51.

Beginning at Start bubble 70 in FIG. 6A, the user must first prime the controller 40 prior to being able to conduct remote operations. This confirms that the user or maintainer 37 is physically present in the proximity of the desired location of the highway-rail grade crossing 20 and controller 40. Of course, there could also be another controller within the transmitting and receiving range of communication device 51, such as at adjacent crossings or the like. The user must also enable the calibration mode and select a track (block 71 in FIG. 6A), such as track 22 in FIG. 2.

The user primes the controller 40 by selecting the Remote Setup option from the user interface on the display 42 of display module 41 (FIG. 3) and requests a one-time use password by selecting a button on the display ("GET PASS") and then presses a button on the CPU module 43. The user is required to press a button at the controller 40 to verify that he/she is physically present and using the intended equipment (this prevents unintentional remote operation to a different controller at a different crossing). The controller 40 then displays a 4-digit randomly generated numeric password (block 72). This password must be entered via the communication device 51 whenever a critical operation is to be performed.

The controller 40 starts a vital timer when the password is requested. If this timer expires, the remote operations are cancelled. The user may change the timer duration, which defaults to about 60 minutes. This timer prevents a user from priming the equipment for remote operation and then forgetting about it, or leaving it primed after completion of remote operation. This vital timer is designed to never time longer than the programmed time even under failure conditions, although it may time shorter than the programmed time, which is the safe condition.

The user selects the track circuits that are to be remotely setup, and/or remote setup for the crossing controller modules. If no track circuit or crossing controller remote setup operations are requested, then the system will not respond to any commands, even monitoring requests. Only tracks and controllers that have been enabled in the system are displayed and can be selected.

The user has now primed the controller 40 for remote operation although it is not active at this time. A record is stored in the event log.

To place the controller 40 into the active remote mode the user will initiate the desired operation by keying "*#" plus the 4-digit password on communication device 51. The communication device 51 passes this initiation request on to the CPU module 43 of controller 40. The controller 40 vitally controls the process, telling the communication module 52 which voice commands to issue to radio 51 and processes the DTMF tone signals. This ensures safe operation since controller 40 is designed to be fail-safe.

When the CPU 43 receives an initiation request it will send a disconnect sequence "*##" via the communication module 52. If another controller 40 is primed and is within communication device signal range, it will respond to a disconnect sequence and terminate any remote operations in progress. This prevents cross talk with adjacent crossings.

The CPU 43 will verify that the password entered is correct. If it is incorrect, the CPU will ignore any DTMF tones from communication device 51 for the next 30 seconds. CPU 43 will then expect to receive a valid password. The controller 40 will not enter the active remote mode until a correct password is entered. This prevents inadvertent control from a different communication device.

If the CPU 43 receives the correct password it will go into the active remote mode and send a voice message with the DOT (Department of Transportation) number for the grade crossing 20 to the radio 51 (block 73 in FIG. 6A). Of course, DOT numbers only apply to the United States and a railroad may use any identifying number that it prefers in place of the DOT number, such as six numeric digits and one alpha digit. This allows the user to verify that he/she is working with the correct crossing. The remote operation is now active, and the CPU 43 will send voice messages via the communication device 51 that list the root menu options (block 74). If the DOT number is not set or is invalid it will be noted as invalid, and an invalid DOT number will prevent calibration if that option is selected.

At any time the user may cancel out of the current menu item by pressing the "*" key, or may cancel remote operation completely with the key sequence "*##" which returns the operation back to the Start bubble 70. While in the root menu (block 74), the user presses a numeric key on the communication device 51 to select the desired option or function. If track (GCP) options are chosen by pressing the "2" key, the CPU 43 will verify that at least one track was enabled for remote operation at decision block 75 (via connector bubble A to FIG. 6B), and then prompt for the track number at block 76. If the track number entered is a valid and enabled track (decision block 77), the various options in the Track Menu (block 80) will be annunciated.

If monitoring options chosen from the Track Menu (block 80) by pressing keys "5" or "6" on communication device 51, the appropriate track or island parameters will be annunciated (blocks 81 or 82, respectively). No password is required for these options.

If any track based calibration option is chosen while in the Track Menu (block 80) by pressing any of keys "1" through "4" on communication device 51, the various options available in the Calibration Menu (via connector bubble D to block 85 in FIGS. 6C1–6C2) will be annunciated at the communication device 51. The track number and the type of calibration selected are included in the Calibration Menu voice message.

If a calibration option is chosen by pressing the "1" key on communication device 51, the DOT number will again be checked (block 86). If it is not valid the system will not let calibration proceed (block 87). Otherwise, the DOT number will be annunciated along with a request to re-enter the password at block 88. The password is required to be entered within a 30 second time window (block 88). If the password is incorrect (block 90) or not entered in time (block 91), it will have to be reentered after a 30 second lockout. If the password is correct (block 89), the CPU 43 will perform the requested calibration (block 92), issuing an in-progress message (block 93), followed by either a success or failure message (blocks 94 or 95, respectively). Success messages are accompanied by a further informational message (blocks 96–99).

If the SSCC option for calibrating or troubleshooting of the traffic warning devices 30 and 31 is selected from the Root Menu (block 74 in FIG. 6A) by pressing the "3" key on communication device 51, the CPU 43 will verify that at least one warning device 30 or 31 was enabled for remote operation. The process then goes via connector bubble C to FIGS. 6D1–6D3 to the SSCC Menu block 100. The options available in the SSCC Menu will then be annunciated at communication device 51. If SSCC setup is selected from the SSCC Menu at block 100 by pressing the "1" or "2" key on communication device 51, calibration of the first warning device 30 or the second warning device 31, respectively, is initiated.

If the "1" key is pressed for the first warning device 30, a further submenu is then annunciated at SSCC 1 Lamp Menu block 102 for selectively activating and calibrating either lamp 1 or lamp 2. These lamps need to be turned on (necessary for calibration), and the voltage of either lamp to be monitored and adjusted (calibrated). Further keypad commands from communication device 51 will selectively turn lamps 1 or 2 on or off for each of the warning devices 30 and 31. The voltages applied to each lamp can then be individually calibrated by entry of further commands at the keypad of communication device 51, as shown in the example of blocks 106–108 for lamp 1 and in blocks 116–118 for lamp 2.

If the "2" key is pressed at the SSCC Menu in block 100 (FIGS. 6D1–6D3) for the second warning device 31, the process goes via connecting bubble G to an SSCC 2 Lamp Menu to block 122 in FIGS. 6E1–6E2. A menu is then annunciated at block 122 for selectively activating and calibrating lamp 1 or lamp 2. The lamps need to be turned on (necessary for calibration), and the voltage of the lamps may be monitored and adjusted (calibrated). Further keypad commands from communication device 51 will selectively turn lamps 1 or 2 on or off (blocks 123–125 and blocks 133–135) for the second warning device 31. The voltages applied to each lamp can then be individually calibrated by entry of further commands at the keypad of communication device 51, as shown in the example of blocks 126–128 for lamp 1 and in blocks 136–138 for lamp 2.

If the Crossing test option is selected from the SSCC Menu in block 100 by pressing the "3" key on communication device 51, a further submenu is annunciated at block 110 that allows the warning devices 30 and 31 to be put into a variety of test modes. These test modes at block 111 may include flashing of the lamps 32 and 33, activation of the gates 34 and 35, activation of any audible devices, timed test runs, repeating tests and terminating the modes.

Once remote operations are concluded, the user is required to review the logs of the controller 40 to make sure that the desired operations were conducted correctly.

It can thus be appreciated that the present invention provides remote calibration and troubleshooting capabilities. It further allows a single person to calibrate or troubleshoot a grade crossing warning system 20 by remotely communicating with controller 40 via a communication device 51, instead of requiring two or more persons as presently done without the present invention.

In cases where only one person was available to calibrate or troubleshoot a crossing, the present invention also provides significant time savings over traditional single-person operation. For example, it typically saves in excess of the equivalent amount of time it would take a maintainer to travel from the crossing to the end of the approach 3 times for a unidirectional track circuit, and up to double this time for a bi-directional track circuit.

Another advantage of the present invention is that it provides remote operation with closed-loop fail-safe controls in place to make sure that only the intended crossing is affected. Only the intended operation(s) are performed for the desired track or crossing controller. Operations are recorded in the log of the controller 40.

The apparatus of the present invention is also compatible with existing equipment, such as the VHF communication device handsets typically employed by the maintainers who perform these operations.

While particular embodiments of the invention have been shown and described, it will be obvious to those skilled in the art that changes and modifications may be made therein without departing from the invention in its broader aspects.

The invention claimed is:

1. A system for remotely calibrating or troubleshooting a highway-rail grade crossing including at least one warning device, said system comprising:

a controller for detecting the approach and presence of a train on the rail;

a communication link coupled to said controller;

a computer readable medium, said computer readable medium having a setup, calibration or troubleshooting segment that is processed by the controller;

a communication device for communicating with said controller through the communication link; and means on said communication device for prompting said controller to selectively process the setup, calibration or troubleshooting segment of the computer readable medium;

said computer readable medium having a segment for priming the controller for remote operation from the communication device.

2. The system in accordance with claim 1, said computer readable medium having a segment for requesting entry of an identifier for the highway-rail grade crossing at the communication device.

3. The system in accordance with claim 1, said computer readable medium having a segment for enabling calibration or monitoring options from the communication device.

4. The system in accordance with claim 1, said computer readable medium having a segment for enabling track calibration or track monitoring options from the communication device.

5. The system in accordance with claim 1, said computer readable medium having a segment for enabling calibration of an approach circuit of the rail from the communication device.

6. The system in accordance with claim 1, said computer readable medium having a segment for enabling calibration of an island circuit of the rail from the communication device.

7. The system in accordance with claim 1, said computer readable medium having a segment for enabling calibration or monitoring of the warning device from the communication device.

8. The system in accordance with claim 7, said segment for enabling calibration or monitoring of the warning device further enabling calibration of at least one lamp in the warning device from the communication device.

9. A method of remotely calibrating or troubleshooting a highway-rail grade crossing including at least one warning device, said method comprising the steps of:

providing a controller for detecting the approach and presence of a train on the rail;

coupling a communication link to said controller;

processing a computer readable medium with said controller, said computer readable medium having a setup, calibration or troubleshooting segment; and communicating between a communication device and said controller through the communication link, prompting said controller from said communication device to selectively process the setup, calibration or troubleshooting segment of the computer readable medium, and priming the controller for remote operation from the communication device by processing a priming segment.

10. The method in accordance with claim 9, said method comprising the further step of:

requesting entry of an identifier for the highway-rail grade crossing at the communication device by processing an identifier segment.

11. The method in accordance with claim 9, said method comprising the further step of:

enabling calibration or monitoring options from the communication device by processing a calibration or monitoring options segment.

12. The method in accordance with claim 9, said method comprising the further step of:

enabling track calibration or track monitoring options from the communication device by processing a track calibration or track monitoring options segment.

13. The method in accordance with claim 9, said method comprising the further step of:

enabling calibration of an approach circuit of the rail from the communication device by processing an approach circuit calibration segment.

14. The method in accordance with claim 9, said method comprising the further step of:

enabling calibration of an island circuit of the rail from the communication device by processing an island circuit calibration segment.

15. The method in accordance with claim 9, said method comprising the further step of:

enabling calibration or monitoring of the warning device from the communication device by processing a warning device calibration or monitoring segment.

16. The method in accordance with claim 15, said method comprising the further step of:

enabling calibration of at least one lamp in the warning device from the communication device by processing the warning device calibration or monitoring segment.

* * * * *